US006182467B1

(12) United States Patent
Zhong et al.

(10) Patent No.: US 6,182,467 B1
(45) Date of Patent: Feb. 6, 2001

(54) LUBRICATION SYSTEM FOR SCREW COMPRESSORS USING AN OIL STILL

(75) Inventors: Jianping Zhong, Manlius; Edward A. Huenniger, Liverpool; Fadi S. Maalouf; Donald Yannascoli, both of Manlius, all of NY (US)

(73) Assignee: Carrier Corporation, Syracuse, NY (US)

( * ) Notice: Under 35 U.S.C. 154(b), the term of this patent shall be extended for 0 days.

(21) Appl. No.: 09/406,424

(22) Filed: Sep. 27, 1999

(51) Int. Cl.[7] ..... F25B 43/02

(52) U.S. Cl. ..... 62/470; 62/471; 62/505; 62/513

(58) Field of Search ..... 62/470, 471, 472, 62/505, 513

(56) References Cited

U.S. PATENT DOCUMENTS 1,922,942 * 8/1933 Gay ..... 62/115
3,336,762 * 8/1967 Patterson ..... 62/84
3,777,509 * 12/1973 Muench ..... 62/470
4,419,865 * 12/1983 Szymaszek ..... 62/193
4,497,185 * 2/1985 Shaw ..... 62/468
5,016,447 * 5/1991 Lane et al. ..... 62/470

* cited by examiner

*Primary Examiner*—William Doerrler
*Assistant Examiner*—Marc Norman

(57) ABSTRACT

A portion of the condensed liquid in a condenser is diverted to a generator where it supplies heat to boil off refrigerant from a refrigerant oil mixture and is thereby subcooled. The subcooled liquid is supplied to the motor for cooling. The boiling off of refrigerant in the generator results in an "oil rich" liquid which is supplied to the bearings, etc. for lubrication. One, or more, jet or ejector pumps are preferably used to supply the oil rich liquid to the lubrication distribution system.

10 Claims, 5 Drawing Sheets

LUBRICATION SYSTEM FOR SCREW COMPRESSORS USING AN OIL STILL

BACKGROUND OF THE INVENTION

In closed refrigeration and air conditioning systems, the refrigerant and lubricant are normally in contact. Because there is an affinity between lubricants and refrigerants, they are present in refrigeration and air conditioning systems as a mixture of varying composition. The composition will depend upon many factors such as the temperature, whether the system is running or not, whether oil is separated by flow through an oil separator or circuitous path, whether the refrigerant undergoes a phase change, etc. The lubricant in the refrigerant tends to coat the surfaces of the system and deteriorates the heat transfer properties of the system. The refrigerant not only dilutes the lubricant, but is subject to outgassing which results from a pressure reduction and produces a froth which can interfere with lubrication.

SUMMARY OF THE INVENTION

A small heat exchanger is preferably located below the cooler or evaporator of a closed refrigeration or air conditioning system and defines an oil rich generator or still. Alternatively, the still may be located at a higher level but would require a pump, or the like. The oil rich generator takes mixed liquid made up of refrigerant and oil from the cooler. A portion of the relatively warm liquid from the condenser is diverted into the generator vessel. In flowing through the tubes in the generator vessel, heat is given up by the flow from the condenser causing the refrigerant in the generator vessel to boil. Alternatively, a supplemental heat source such as electric resistance heat may be used. The resulting refrigerant vapor is vented from the vessel and flows to the compressor suction due to the pressure differential between the compressor suction and the cooler. The boiling off of refrigerant results in an "oil rich" liquid. The oil rich liquid is supplied to the lubrication system via one, or more, ejectors which cause the oil rich liquid to be entrained in high pressure gas diverted from the compressor. The pressure driving the ejectors is, preferably, the higher of the discharge pressure or the last closed lobe rotor pressure.

In passing through the generator, the refrigerant flow from the condenser is subcooled. This relatively high pressure, subcooled flow is supplied to the motor for cooling. In cooling the motor, the subcooled flow is heated and expanded and is subsequently supplied to the suction flow to the compressor.

It is an object of this invention to generate an oil rich fluid to lubricate screw compressor bearings.

It is an additional object of this invention to provide separate lubrication circuits for the rotors and bearings of a screw compressor.

It is another object of this invention to reduce the refrigerant content of an oil-refrigerant mixture.

It is an object of this invention to eliminate the complexity of typical oil separation systems thereby lowering the cost and improving the system reliability.

It is a further object of this invention to generate subcooled liquid for motor cooling. These objects, and others as will become apparent hereinafter, are accomplished by the present invention.

Basically, supplemental heat or a portion of the condensed liquid in a condenser is diverted to a generator or still where it supplies heat to boil off refrigerant from a refrigerant oil mixture and is thereby subcooled. The subcooled liquid is supplied to the motor for cooling. The boiling off of refrigerant in the generator results in an "oil rich" liquid which is supplied to the bearings for lubrication. One, or more, jet or ejector pumps are preferably used to supply the oil rich liquid to the lubrication distribution system for lubricating the bearings. Preferably, an oil rich zone in the cooler supplies lubricant for lubrication and/or sealing of the rotors via a second lubrication distribution system.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
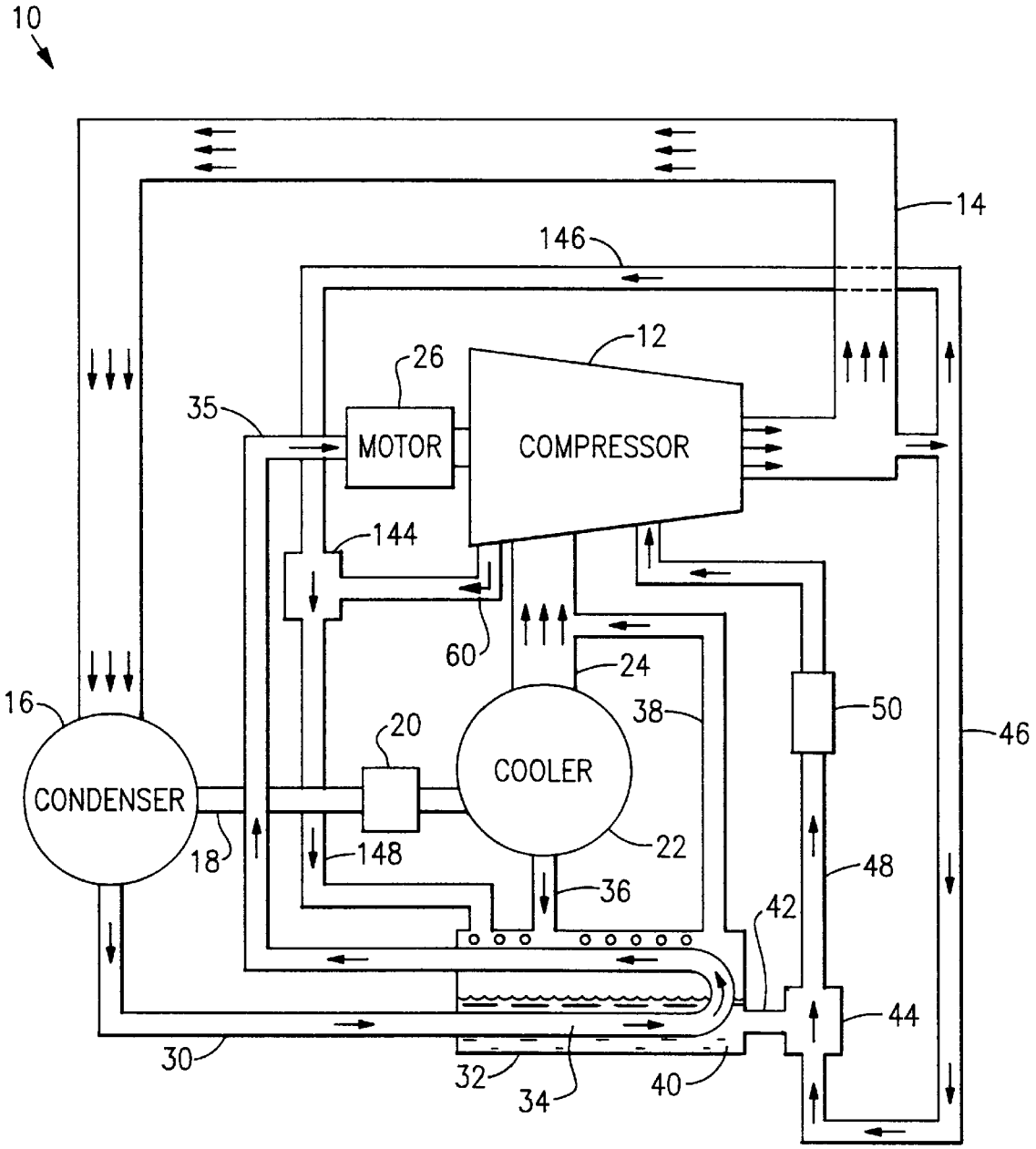
FIG. 1 is a schematic diagram of a closed refrigeration or air conditioning system employing the present invention.
Figure 2:
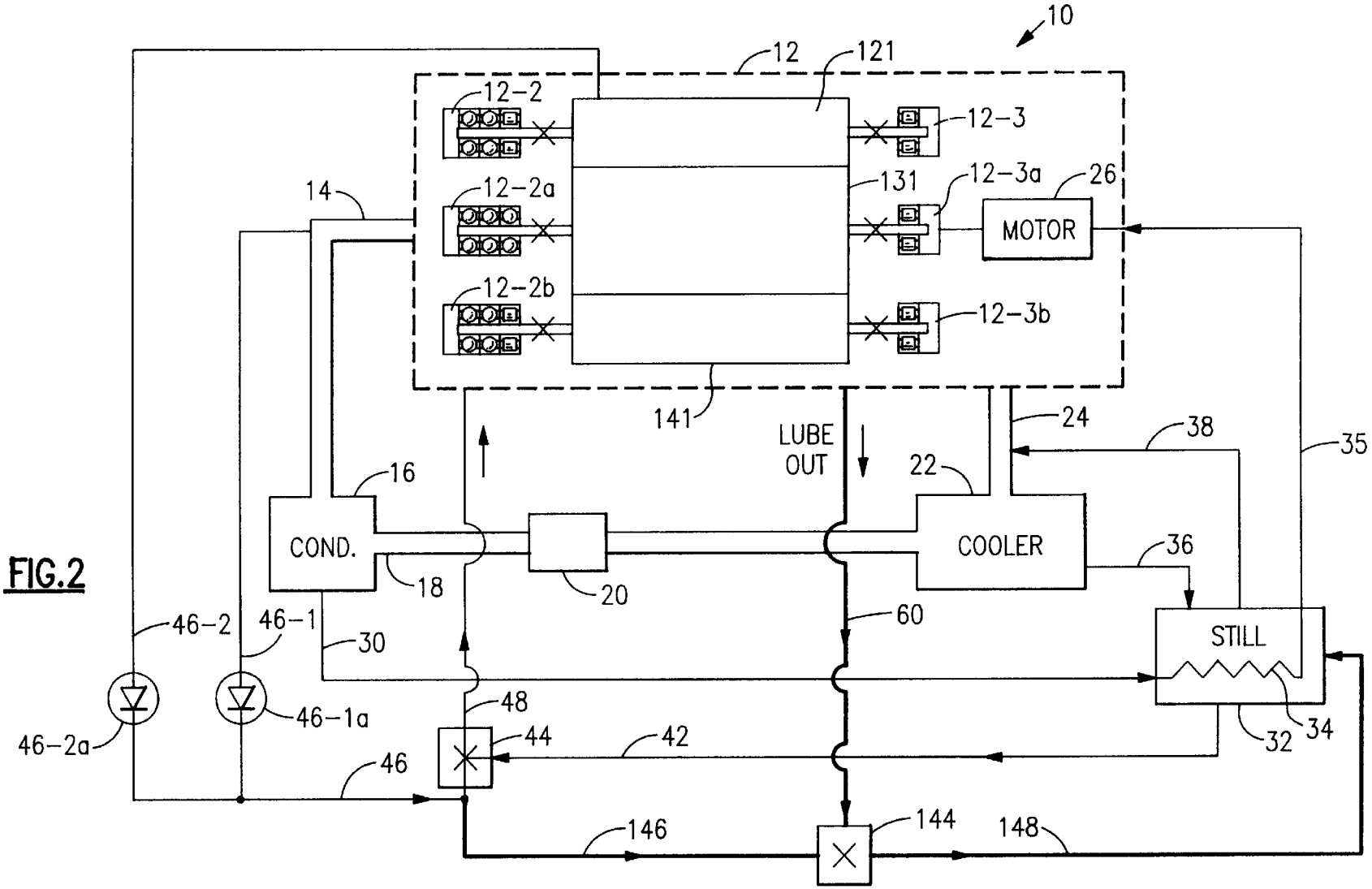
FIG. 2 is a more detailed schematic diagram of the FIG. 1 system.
Figure 3:
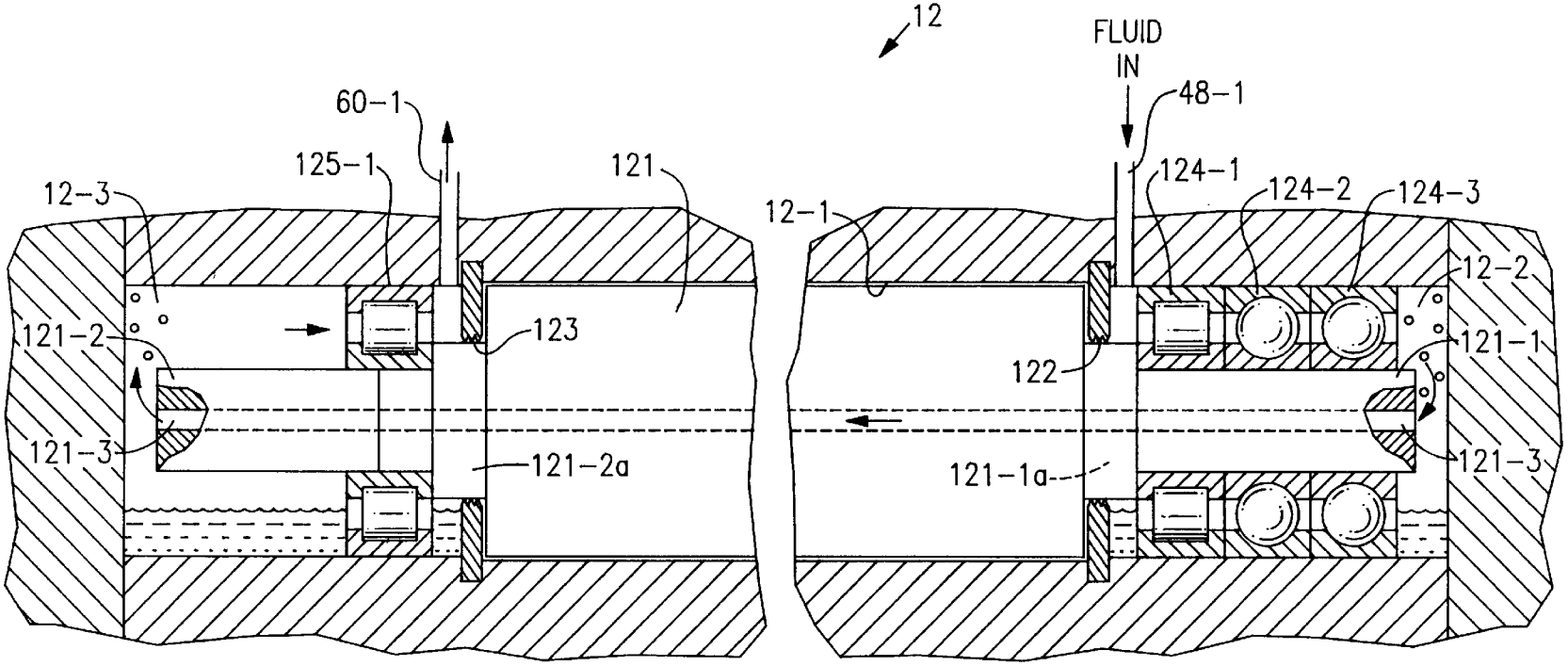
FIG. 3 is a partially cutaway sectional view of a screw rotor showing a portion of the lubricant path.
Figure 5:
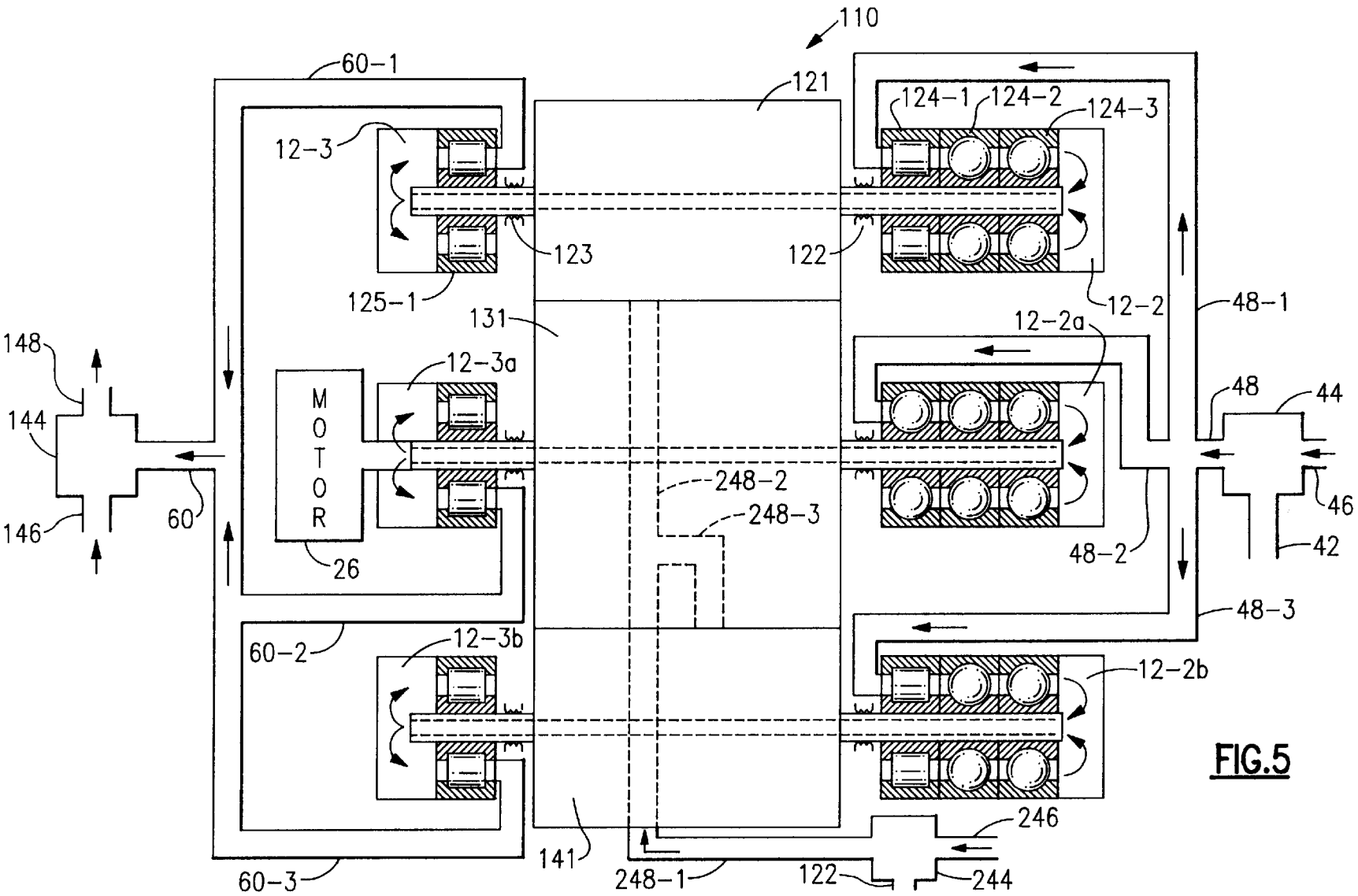
FIG. 5 is a schematic diagram of a portion of the lubrication flow path of the FIG. 4 system.

In FIG. 1, the numeral 10 generally designates a closed refrigeration or air conditioning system. As is conventional, there is a closed circuit serially including compressor 12, discharge line 14 connected to the discharge port, condenser 16, line 18 which contains expansion device 20, cooler or evaporator 22 and suction line 24 leading to the suction port. Compressor 12 is a multi-rotor, hermetic, screw compressor and is driven by electric motor 26 which is connected to a source of electric power (not illustrated). As is best shown in FIGS. 2 and 5, screw compressor 12 has a plurality of intermeshing rotors with three rotors 121, 131 and 141 being illustrated. Referring specifically to FIG. 3, rotor 121 has end shafts 1211 and 121-2 and an axial bore 121-3 extending the full length of rotor 121 and shafts 121-1 and 121-2. End shafts 121-1 and 121-2 are connected to rotor 121 through intermediate shafts 121-1*a* and 121-2*a*, respectively. Intermediate shafts 121-1*a* and 121-2*a* are in a tight clearance relationship with labyrinth seals 122 and 123. Labyrinth seal 122 seals rotor bore 12-1 from bearing chamber 12-2. Similarly, labyrinth seal 123 seals rotor bore 12-1 from bearing chamber 12-3. Shaft 121-1 is supported in bearing chamber 12-2 by a plurality of bearings 124-1, 124-2 and 124-3. Similarly, shaft 121-2 is supported in bearing chamber 12-3 by bearing 125-1.

Rotor 121, as illustrated in FIG. 3, and described above, is representative of rotors 131 and 141 relative to bearing support and lubrication. The only differences would be that there are both male and female rotors and that one rotor would be driven by motor 26 and would, in turn, drive the other rotors. In gears the driving gear is the "sun" and the driven gears are the "planets". The rotors can be driven through gears rather than directly through the rotors.

Referring again to FIG. 1, according to the teachings of the present invention, a portion of the relatively warm liquid in condenser 16 passes via line 30 to generator vessel or still 32. Preferably, generator vessel or still 32 is located below or at a lower level than cooler 22. If necessary, or desirable, generator vessel or still 32 can be located at a higher level but would require pumping to supply the still. The liquid from condenser 16 supplied via line 30 passes through a plurality of tubes 34 in a heat exchange relationship with the refrigerant-oil mixed liquid which flows into generator vessel 32 from cooler 22 via line 36. After passing through the tubes 34, the flow is supplied via line 35 to motor 26 for cooling motor 26 and subsequently combines with the suction gas supplied via line 24. The diverted flow from the condenser 16 gives off heat to the refrigerant-oil mixture in generator 32 causing the refrigerant to boil while the flow from the condenser 16 is cooled. The vapor resulting from the boiling of refrigerant is vented out of generator vessel 32 via line 38 which connects to the compressor suction line 24 and flows into the compressor suction due to the pressure differential between the compressor suction and cooler 22.

Due to the boiling off of refrigerant, an oil rich liquid 40 is produced in generator vessel 32. The oil rich liquid 40 is supplied via line 42 to ejector 44. A portion of the compressor discharge or last closed lobe rotor fluid is diverted to ejector 44 via line 46 and entrains oil rich liquid from generator 32 and carries it into line 48 which may contain one or more filters 50. Line 48 branches into a plurality of lines. Lines 48-1, 48-2 and 48-3, respectively, are connected to the upper portion of the bearing housings, as best shown in FIG. 3 with respect to line 48-1, and feed the bearing chambers 12-2, 12-2*a* and 12-2*b* located on the discharge or high pressure side of compressor 12.

Referring specifically to FIG. 3 as typical of the supplying of lubrication to bearing chambers 12-2, 12-2*a* and 12-2*b*, it will be noted that branch 48-1 connects with the top of bearing chamber 12-2. The lubricant supplied via branch 48-1 flows through and over bearings 124-1, 124-2 and 124-3 thereby lubricating them. The oil and gaseous refrigerant in bearing chamber 12-2 flows into and through axial bore 121-3 in rotor 121 and flows into bearing chamber 12-3. The oil flowing into bearing chamber 12-3 flows over and through bearing 125-1 before passing into branch line 60-1 which connects with line 60 and, ultimately, still 32. Similarly, oil passes from bearing chambers 12-3*a* and 12-3*b* via branch lines 60-2 and 60-3, respectively, into line 60. Line 60 connects with second ejector 144 and a portion of the compressor discharge or last closed lobe rotor fluid is diverted to ejector 144 via line 146 and entrains oil drawn from cavities 12-3, 12-3*a* and 12-3*b* and, preferably, returns the oil to still 32. If necessary, or desired, the oil can be carried into cooler 22 instead of still 32.

FIG. 2 adds to the illustrated structure of FIG. 1 the feeding of the higher of discharge and last closed lobe rotor pressure to ejectors 44 and 144 as the motive fluid. Line 46 which feeds ejector 44 is feed from one of two branch lines 46-1 and 46-2, containing check valves 46-1*a* and 46-2*a*, respectively. Line 46-1*a* supplies compressor discharge pressure to ejector 44 and line 46-2*a* supplies the last closed lobe pressure to ejector 44 with the higher of the two pressures being supplied to the ejector 44. The oil return path 148 is to still 32.

Figure 4:
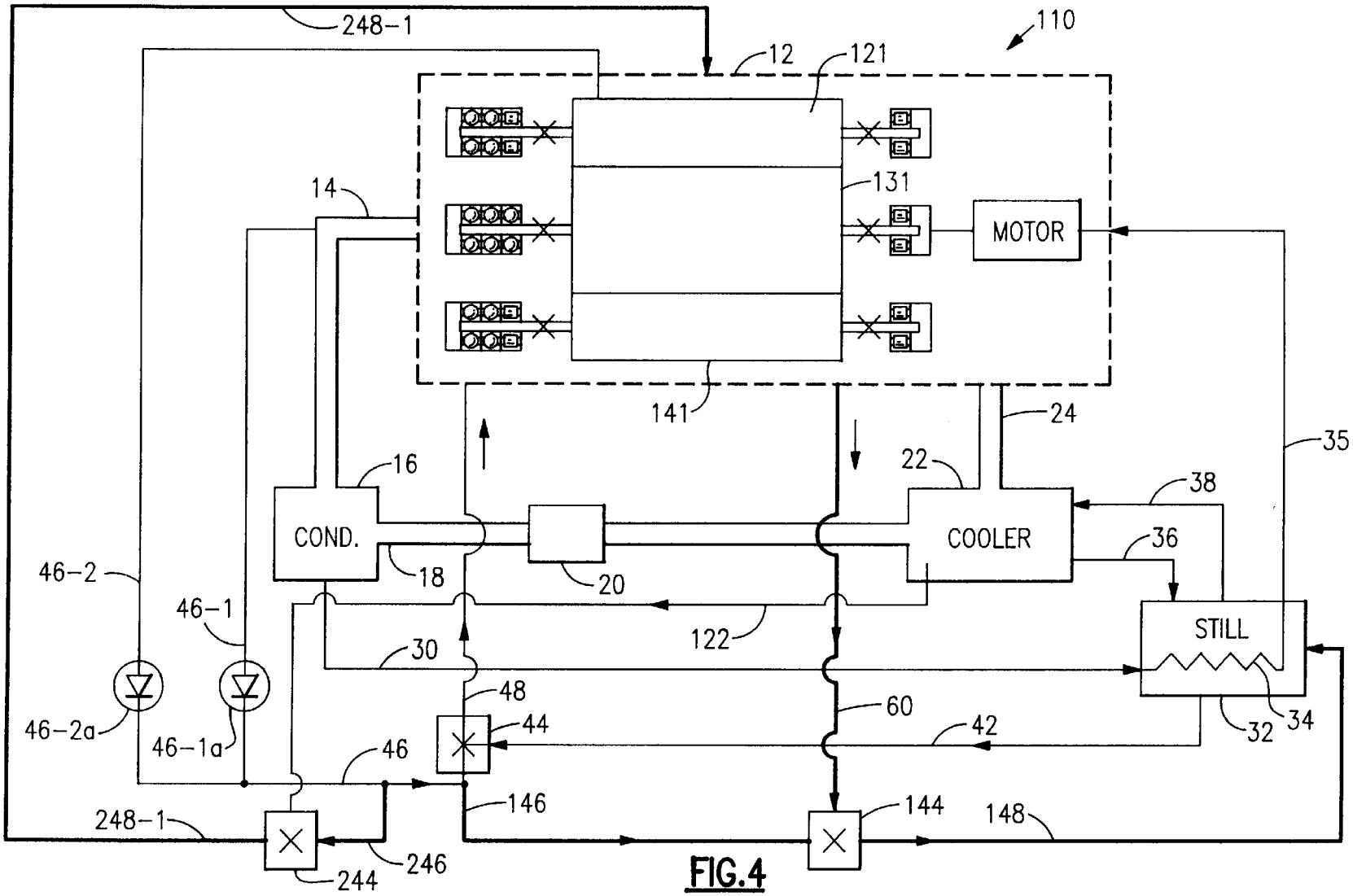
FIG. 4 is a schematic diagram of a modified lubrication system.

System 110 of FIGS. 4 and 5 differs from system 10 of FIGS. 1 and 2 by adding the supplying of lubricant for lubricating and/or sealing the rotors being drawn from cooler 22 via line 122 and supplied to a third ejector 244. Specifically, line 246 branches off of line 46 and supplies the higher of discharge pressure and last closed lobe rotor pressure to ejector 244 causing oil in a refrigerant oil mixture to be drawn from cooler 22 via line 122 and to be supplied via line 248-1 to compressor 12 for lubricating rotors 121, 131 and 141. FIG. 5 provides a more detailed view of the rotor lubrication path. This embodiment takes advantage of the fact that the rotors 121, 131 and 141 do not require the oil rich mixture that is required by the bearings since its major function is sealing rather than lubrication. Advantage is also taken of the fact that an oil rich zone tends to form in cooler 22 such that the fluid connection of line 122 to cooler 22 can be located so as to withdraw oil from this zone. Additionally, the use of three ejectors reduces the demand placed on them. Referring specifically to FIG. 5 it will be noted that line 248-1 divides into line 248-2 which lubricates rotors 121 and 131 and line 248-3 which lubricates rotors 131 and 141. As noted, branch lines 60-1, 60-2 and 60-3 lead from the upper portion of the bearing chambers 12-3, 12-3*a* and 12-3*b* on the suction or low pressure side of the compressor 12 and combine in line 60 which returns the oil to still 32.

Although preferred embodiments of the present invention have been illustrated and described, other changes will occur to those skilled in the art. It is therefore intended that the scope of the present invention is to be limited only by the scope of the appended claims.

What is claimed is:

1. A closed refrigeration system containing refrigerant and oil and serially including a compressor having a suction port and a discharge port and driven by a motor, a discharge line extending from said discharge port to a condenser, an expansion device, a cooler and a suction line connected to said suction port, the improvement comprising:

a generator fluidly connected to said cooler for receiving a fluid mixture containing refrigerant and oil from said cooler;

means for supplying a liquid refrigerant and oil mixture from said condenser to said generator in a heat exchange relationship with said fluid mixture in said generator whereby refrigerant is boiled off from said fluid mixture producing an oil-rich mixture;

means for supplying boiled off refrigerant from said generator to said suction port;

means for pumping;

a lubrication distribution system connected to said means for pumping;

means for supplying said oil-rich mixture from said generator to said means for pumping;

means for causing said means for pumping to cause said oil-rich mixture to be supplied to said lubrication distribution system;

said lubrication system providing lubrication to said compressor.

2. The closed refrigeration system of claim 1 wherein said means for supplying a liquid refrigerant and oil mixture from said condenser to said generator is fluidly connected to said motor whereby said liquid refrigerant and oil mixture is subcooled in passing through said generator and subsequently provides cooling to said motor.

3. The closed refrigeration system of claim 1 wherein said compressor is a screw compressor having a plurality of inter-engaging rotors.

4. The closed refrigeration system of claim 3 wherein:

each of said rotors has a first end and a second end and axial bore extending between said ends, said ends being supported by bearings located in bearing chambers fluidly sealed from said rotors;

said lubrication system including said bearing chambers and said axial bore for each of said rotors.

5. The closed refrigeration system of claim 1 wherein said means for pumping is an ejector pump and said means for causing supplies high pressure refrigerant to said ejector pump at the higher of discharge pressure and last closed lobe pressure.

6. The closed refrigeration system of claim 5 further including:

a second ejector pump;

means for supplying high pressure refrigerant to said second ejector pump;

said lubrication distribution system including a return line;

said second ejector pump being operatively connected to said return line such that high pressure refrigerant being supplied to said second ejector pump causes oil to be drawn from said compressor via said return line and supplied to said second ejector pump.

7. The closed refrigeration system of claim 6 wherein said second ejector pump is connected to said generator and delivers oil drawn from said compressor via said return line to said generator.

8. The closed refrigeration system of claim 7 further including:

a third ejector pump;

means for supplying high pressure refrigerant to said third ejector pump;

said third ejector pump being operatively connected to said cooler;

said compressor being a screw compressor having a plurality of inter-engaging rotors;

means connected to said third ejector pump for supplying a refrigerant-oil mixture drawn from said cooler to said rotors for lubrication and sealing when high pressure refrigerant is supplied to said third ejector pump.

9. The closed refrigeration system of claim 1 wherein;

said compressor is a screw compressor having a plurality of inter-engaging rotors supported by bearings; and said lubrication system provides lubricant to said rotors and said bearings.

10. The closed refrigeration system of claim 1 wherein said lubrication system includes a return line connected to said generator.

* * * * *